US006097410A

United States Patent [19]

Yamasa et al.

[11] Patent Number: 6,097,410

[45] Date of Patent: Aug. 1, 2000

[54] METHOD AND APPARATUS FOR FORMING AN IMAGE ON A RECORDING MEDIUM WHEREIN INK EMISSION IS ACCURATELY CONTROLLED BY VARYING THE SURFACE LEVEL OF CHARGEABLE DEVELOPER INK

[75] Inventors: Hideo Yamasa, Yamatokoriyama; Kouichi Irihara, Nara, both of Japan

[73] Assignee: Sharp Kabushiki Kaisha, Osaka, Japan

[21] Appl. No.: 09/139,789

[22] Filed: Aug. 25, 1998

[30] Foreign Application Priority Data

Aug. 25, 1997 [JP] Japan ..... 9-227850

[51] Int. Cl.[7] ..... B41J 2/06

[52] U.S. Cl. ..... 347/55

[58] Field of Search ..... 347/55, 120, 123, 347/111, 85, 84, 100, 103, 154, 127, 128, 151; 399/271, 290, 292, 293, 294, 295

[56] References Cited

U.S. PATENT DOCUMENTS 5,036,341 7/1991 Larsson .
5,912,692 6/1999 Kuehnle ..... 347/123

FOREIGN PATENT DOCUMENTS 1-503221 11/1989 Japan .
7-186436 7/1995 Japan .
8-006383 1/1996 Japan .
WO 93/11866 6/1993 WIPO .

*Primary Examiner*—John Barlow
*Assistant Examiner*—Raquel Yvette Gordon
*Attorney, Agent, or Firm*—David G. Conlin; Richard E. Gamache

[57] ABSTRACT

An image forming apparatus includes an ink tank accommodating chargeable developer ink, an ink control layer having a plurality of ink supply holes arranged in a matrix, arranged near the surface of the developer ink and having a lower portion opened in the developer ink, a potential control layer arranged above the ink control layer and having a plurality of ink passage holes arranged in the column direction of the ink supply holes, an opposing electrode arranged opposing to the potential control layer, a power supply unit for applying a potential to the developer ink and an opposing electrode to generate a prescribed potential difference between the developer ink and an opposing electrode, a surface level controller for changing surface level of the developer ink in the ink supply holes for each column of the ink supply holes, and an emission controller for controlling potential of each row of the ink supply holes in the ink passage holes of the potential control layer for controlling ink emission dot by dot.

20 Claims, 14 Drawing Sheets

6
33
37
38
b POSITION
a POSITION

POTENTIAL
Vs
Vm
Vb

ELECTRIC FIELD STRENGTH
Ea Eth Eb

POTENTIAL
Vs
Vo
Vb

ELECTRIC FIELD STRENGTH
Ea' Eb'Eth 6
33
37
38
b POSITION
a POSITION

POTENTIAL
Vs'
Vp
Vb'

ELECTRIC FIELD STRENGTH
Ea''
Eth
Eb''

POTENTIAL
Vs'
Vq
Vb'

ELECTRIC FIELD STRENGTH
Ea'''
Eth
Eb'''

METHOD AND APPARATUS FOR FORMING AN IMAGE ON A RECORDING MEDIUM WHEREIN INK EMISSION IS ACCURATELY CONTROLLED BY VARYING THE SURFACE LEVEL OF CHARGEABLE DEVELOPER INK

BACKGROUND OF THE INVENTION

1. Field of the Invention

The present invention relates to a method and apparatus for image formation utilized in a printing unit of a digital copying machine or a facsimile apparatus, or in a digital printer. More particularly, the present invention relates to a method and apparatus of image formation in which an image is formed on a recording medium by emission of developer ink.

2. Description of the Background Art

A method generally referred to as xerography is used in some of the image forming apparatuses in which image signals are output as a visible image on a recording medium such as a sheet of paper. In such an image forming apparatus, an electrostatic latent image is formed by optical writing means on a developing body having electro-optical characteristics, that is, on a photoreceptor. Thereafter, toner as developer particles is attached to the electrostatic latent image, so that the image is developed, or visualized. Finally, the image is transferred to a recording medium such as a sheet of paper, whereby the image signals are provided as a visible image on the recording medium.

In such a conventional image forming apparatus, a developing body having special structure has been necessary for forming the electrostatic latent image. Further, means for writing the electrostatic latent image to the photoreceptor, as well as means for erasing remaining charges on the developing body have been necessary. Further, a complicated structure for transferring the toner image formed on the developing body onto the recording medium is also necessary. Accordingly, the conventional image forming apparatus has a complicated structure, and therefore reduction in size is difficult.

In view of the foregoing, Japanese National Publication No. 01-503221, Japanese Patent Laying-Open No. 07-186436 and so on propose an image forming apparatus employing a different method free of the above described problems. In the image forming apparatus described in these published applications, charged toner is carried on a toner carrier roller, and the toner is directly emitted by Coulomb force to the recording medium, whereby an image is formed. This method of recording images will be referred to as toner emission recording method in the specification.

In the following, a conventional image forming apparatus employing the toner emission recording method will be described. Referring to FIG. 23, the conventional image forming apparatus includes a developer tank 1, a toner carrier 2 carrying toner 4, a toner supply roller 3 and a layer thickness regulating member 5 which are brought in pressure contact with toner carrier 2 and provided inside developer tank 1, an opposing electrode 6 arranged opposing to toner carrier 2 and on a side opposite to a recording medium 7 conveyed in the direction of a fixing roller 8, and a control electrode 9 arranged between opposing electrode 6 and toner carrier 2 and between recording medium 7 and toner carrier 2.

Referring to FIGS. 24 and 25, control electrode 9 includes a plurality of electrodes (X direction electrodes) 10 stacked on each other and parallel to the longitudinal direction of the toner supply roller, a thin film insulator 11 having a thickness of several tens $\mu$m, and a plurality of electrodes (Y direction electrodes) 12 in a direction crossing the X direction electrodes 10. At intersections between X direction electrodes 10 and Y direction electrodes 12, toner passage holes 13 are formed.

The image forming apparatus structured as described above operates in the following manner. Here, it is assumed that toner 4 is negatively charged. Toner 4 in developer tank 1 is supplied by toner supply roller 3 to toner carrier 2. At this time, by the friction between toner carrier 2 and toner supply roller 3, toner 4 is negatively charged and supplied to toner carrier 2. Toner 4 which is adhering to toner carrier 2 is conveyed to layer thickness regulating member 5 and again charged by the regulating member 5 and, at the same time, has its thickness regulated to a constant thickness of 10 to 50 $\mu$m. Thereafter, toner is conveyed to a position opposing to control electrode 9 by toner carrier 2.

Control electrode 9 is connected to a driving circuit 15 which operates based on a signal from a control circuit 14 generating the signal in accordance with image information. To ones of X direction electrodes 10 and Y direction electrodes 12 which are selected by control circuit 14, Va volt is applied when a dot is to be printed, and Vb is applied when the dot is not to be printed. To toner carrier 2, Vs volt is applied by an external charges 16, and Vt volt is applied to opposing electrode 6 by an external power supply 17. The values Va, Vb, Vs and Vt are predetermined to allow control of toner emission. More specifically, the voltage values are predetermined to allow control of toner emission by electromagnetically varying strength of electric field generated between toner carrier 2 and opposing electrode 6 by the potentials (Va, Vb) applied to each one of the control electrodes.

Toner 4 which is negatively charged and conveyed to the position opposing to control electrode 9 by toner carrier 2 is emitted toward toner passage hole 13, when an electric field stronger than the electric field allowing start of emission is formed as Va volt is applied to X direction electrodes 10 and Y direction electrode 12, as a dot is to be printed. Toner 4 which has been emitted and reached toner passage hole 13 receives the force of the electric field toward recording medium 7 by the opposing electrode 6 to which Vt volt is applied, and the toner is transferred to recording medium 7.

When the dot is not to be printed, Vb volt is applied to either one of or both of Y direction electrode 10 and Y direction electrode 12. Therefore, the strength of the generated electric field does not reach the strength of the electric field which allows start of toner emission, and therefore the negatively charged toner 4 is not emitted to toner passage hole 13.

Referring to FIG. 25, toner passage hole 13 is so arranged as to form four rows of toner passage holes 13 parallel in the longitudinal direction of toner carrier 2, with adjacent dots partially overlapped with each other, so that a line image can be represented by continuous dots. By changing the timing of control of toner passage holes 13 formed parallel to the toner carrier 2, an image is formed. Recording medium 7 on which a visible image is formed is fed to fixing roller 8, and the image is fixed.

In the conventional structure described above, toner emission is said to be controlled by electromagnetically varying the strength of the electric field generated between toner carrier 2 and opposing electrode 6 by the potentials (Va, Vb) applied to the X and Y direction electrodes 10 and 12. Actually, however, the toner may erroneously be emitted when emission voltage Va is applied only to X direction electrode 10 or Y direction electrode 12, and the operation has been unstable.

Further, it has been found that the above described structure suffers from another problem that satisfactory image cannot be stably formed for a long period of time as the toner is deposited on the surface of control electrode 9 or the toner passage hole 13 is clogged by the toner. To ensure stable image formation, the control electrode should be well maintained.

The inventors have found that these problems apt to occur when there is much toner charged in opposite polarity, or much toner weakly charged. Further, it has been found through observation of the state of toner emission that the toner particles travel not particle by particle but in a cluster of a few to several toner particles. When the cluster of toner particles travel, the cluster may be divided during the travel, and particles may possibly move in directions other than the initial intended direction. This may be one of the causes of the above described problems.

In view of the foregoing, a proposal has been made (Japanese Patent Laying-Open No. 8-6383) in which an apparatus for removing toner charged in opposite polarity or weakly charged toner in the developer tank. However, this proposal makes the apparatus complicated, and increases overall cost.

The conventional structure requires a charging apparatus for charging the toner and a fixing roller for fixing the toner adhering to the recording medium. Therefore, the structure is complicated and large. Such an image forming apparatus is mainly used in offices, which generally are positioned in areas where land price or rent is high. Therefore, the image forming apparatus should occupy as small an area as possible.

SUMMARY OF THE INVENTION

The present invention was made in view of the conventional problems and an object of the present invention is to provide a method and an apparatus for image formation which allows more stable and reliable emission control of toner particles.

Another object of the present invention is to provide a method and an apparatus of image formation which allows more stable and reliable emission control of toner particles and facilitates maintenance of the apparatus.

A still further object of the present invention is to provide a method and an apparatus of image formation which allows more stable and reliable emission control of toner particles and ensures good image quality for a long period of time without the necessity of maintenance of control electrodes including cleaning and exchange.

An additional object of the present invention is to provide an image forming apparatus which allows more stable and reliable emission control of toner particles, ensures good image quality for a long period of time without the necessity of maintenance of control electrodes including cleaning and exchange, and which allows reduction in size.

A still further object of the present invention is to provide an image forming apparatus which allows more stable and reliable emission control of toner particles, ensures good image quality for a long period of time without the necessity of maintenance of control electrodes including cleaning and exchange, and allows reduction in size, manufactured at a low cost.

The image forming apparatus in accordance with the present invention includes an ink tank opened upward containing chargeable developer ink; an ink control layer having a plurality of ink supply holes arranged in a matrix of a prescribed number of rows and a prescribed number of columns, arranged near the surface of developer ink contained in the ink tank, and having its lower portion opened in the developer ink; a potential control layer arranged adjacent to and above the ink control layer, having a plurality of ink passage holes arranged in the column direction of the plurality of ink supply holes; an opposing electrode arranged above and opposing to the potential control layer; a power supply unit for applying potentials to either one of or both of the developer ink and the opposing electrode so that a prescribed potential difference is generated between the developer ink and the opposing electrode; a surface level controller for changing surface level of the developer ink in the ink supply holes, for each column of the plurality of ink supply holes; and an emission controller for controlling emission of ink dot by dot, by controlling potential of each row of the plurality of ink supply holes.

As the surface level is controlled, at a region where the surface of the developer ink is positioned low, ink is not emitted regardless of the potential control by the emission controller. In a region where the surface of the developer ink is positioned high, ink is emitted stably and reliably at a portion where the potential is controlled to allow emission by the emission controller. At a portion where the potential is controlled to prevent emission by the emission controller, ink is not emitted. Accordingly, emission control of the developer ink is more stable and reliable. As chargeable developer ink is used as the developer particles, neither a special apparatus for charging which has been necessary for charging the toner, nor the fixing apparatus, is required. Accordingly, good image quality is ensured stably for a long period of time without cleaning or exchange of the control electrode for a long period of time, and therefore maintenance of the apparatus is facilitated. Further, as the number of necessary parts is reduced, the structure of the apparatus is simplified, manufacturing cost is reduced and the apparatus can be made compact.

Preferably, the surface level controller includes an electric field controller for controlling surface level of the developer ink in the supply holes of the ink control layer by electric field. In another embodiment, the surface level controller includes a mechanical controller for mechanically controlling the surface level of the developer ink in the supply holes of the ink control layer. In a still further embodiment, the surface level controller includes a thermal level controller for thermally controlling the surface level of the developer ink in the supply holes of the ink control layer.

According to another aspect of the present invention, the method of image formation includes the steps of: changing surface level of the developer ink in ink supply holes, for every column of the plurality of ink supply holes; and controlling ink emission dot by dot by controlling potential of each row of the plurality of ink supply holes, in the passage holes of the potential control layer.

Preferably, the step of changing the surface level includes the step of applying potential of a prescribed polarity to the developer ink in the ink tank, and the step of generating an electric field of the prescribed polarity near an upper portion of the supply holes of each column of the ink control layer. In another embodiment, the step of changing the surface level includes the step of changing the surface level of the developer ink separately for each column, by a mechanical controller. In a still another embodiment, the step of changing the surface level includes the step of changing separately the surface level of the developer ink for every column in the ink supply holes, using a thermal level controller.

In accordance with a still further aspect of the present invention, the image forming apparatus includes an ink tank opened upward, containing chargeable developer ink; a surface level controller arranged near the surface of the developer ink in the ink tank, responsive to a signal designating a region of image formation, for selectively controlling surface level of the developer ink; an opposing electrode arranged above and opposing to the ink tank; a power supply unit for applying a potential to either one of or both of the developer ink and an opposing electrode so as to generate a prescribed potential difference between the developer ink and opposing electrodes; and an electric field controller arranged intermediate between the developer ink and opposing electrode, responsive to a signal generated in accordance with image information, for selectively changing electric field between the surface of the developer ink and opposing electrode, so as to emit the developer ink only at that portion which is designated by the signal generated in accordance with the image information in that area of which surface level is made higher by the surface level controller, toward the opposing electrode.

As the surface level of the developer ink is controlled selectively, at a region where the surface of the developer ink is positioned low, the ink is not emitted regardless of the potential control by the emission controller. In a region where the surface of the developer ink is positioned high, at a portion where the potential is controlled to allow emission by the emission controller, the ink is emitted stably and reliably. At a portion where the potential is controlled to prevent emission by the emission controller, ink is not emitted. Therefore, emission control of the developer ink is more stable and reliable. As chargeable developer ink is used as the developer particles, neither special charging apparatus which has been necessary for charging the toner, nor the fixing apparatus is required. Therefore, good image quality is ensured stably for a long period of time even without cleaning or exchange of the control electrode for a long period of time, which facilitates maintenance of the apparatus. Further, as the number of necessary parts is reduced, the structure of the apparatus is simplified, manufacturing cost is reduced and the apparatus can be made compact.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

First Embodiment

Figure 1:
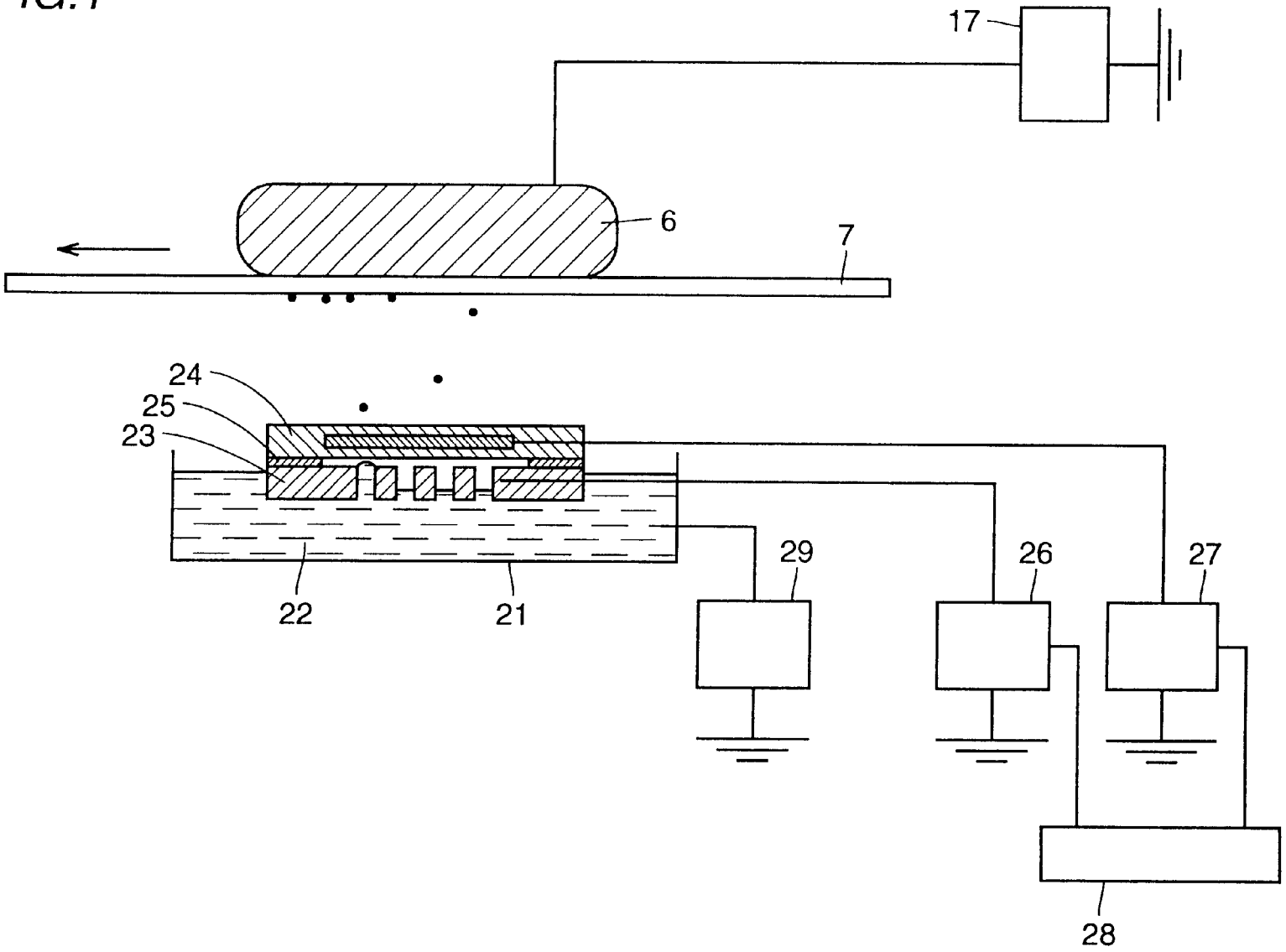
FIG. 1 schematically shows a structure of an image forming apparatus in accordance with a first embodiment of the present invention.

Referring to FIG. 1, the image forming apparatus in accordance with the first embodiment of the present invention includes an ink tank 21 in which a conductive ink 22 is accommodated, an ink control layer 23 of which lower side is dipped to a predetermined depth in conductive ink 22, an emission control layer 24 arranged adjacent to ink control layer 23 with a spacer 25 interposed on that side of ink control layer 23 which is opposite to conductive ink 22, an opposing electrode provided at several mm to 1 cm apart from emission control layer 24, and a power supply 17 for applying a predetermined potential to opposing electrode 6. A voltage is applied to conductive ink 22 of ink tank 21 by an external power supply 29 so that the ink surface attains −100 V. Conductive ink 22 is uniformly charged, with no variation in the amount of charges.

Image forming apparatus further includes a control circuit 28 generating a signal in accordance with image information, and driving power supplies 26 and 27 for applying voltages to each of ink supply control electrodes 30 and emission control electrodes 33, based on the signal from control circuit 28.

Figure 2:
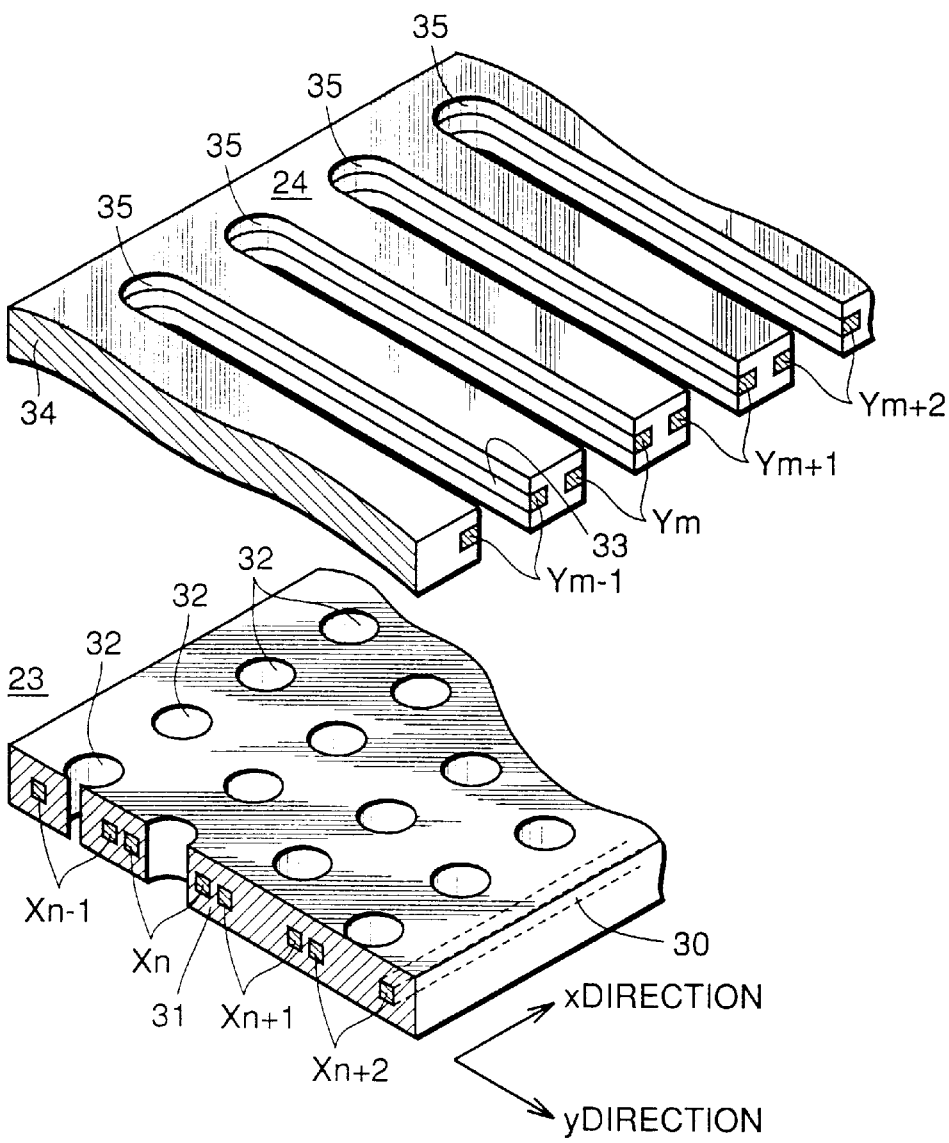
FIG. 2 is a perspective view partially in cross section showing, in enlargement, the ink control layer and the potential control layer of the image forming apparatus in accordance with the first embodiment of the present invention.

Referring to FIG. 2, ink control layer 23 includes an insulator 31 in the form of a thin plate having a thickness of few mm. Insulator 31 has a plurality of ink supply holes 32 formed arranged in a two-dimensional matrix in x and y directions at a prescribed pitch. Here, x and y directions are not necessarily be orthogonally intersecting with each other. Ink control layer 23 further includes a plurality of pairs Xn (n is a positive integer) of ink supply control electrodes 30 (x direction electrodes) parallel to the longitudinal direction of ink control layer 23, formed on both sides of each column of ink supply holes 32 in the x direction and embedded therein. Diameter of ink supply hole 32 is predetermined such that ink particle has an appropriate diameter when the ink is emitted through ink supply hole 32. Ink control layer 23 is arranged such that the ink control layer 23 is close to the surface of conductive ink 22 when conductive ink 22 is accommodated in ink tank 21. Therefore, the lower portion of ink supply hole 32 is opened in conductive ink 22.

Referring to FIG. 2, emission control layer 24 is positioned at a close distance of 0.5 to 1 mm from the upper surface of ink control layer 23 by means of a spacer 25. Emission control layer 24 includes an insulator 34 in the form of a film or a thin plate having the thickness of 0.05 to several mm, having a plurality of ink particle passage slits 35 formed in a direction crossing X direction ink supply control electrodes 30, and a plurality of emission control electrodes 33 (Y direction electrodes) embedded therein, formed one pair Ym by one pair at front and rear portions of each of the ink particle passage slits 35.

The image forming apparatus structured as described above operates in the following manner.

Figure 3:
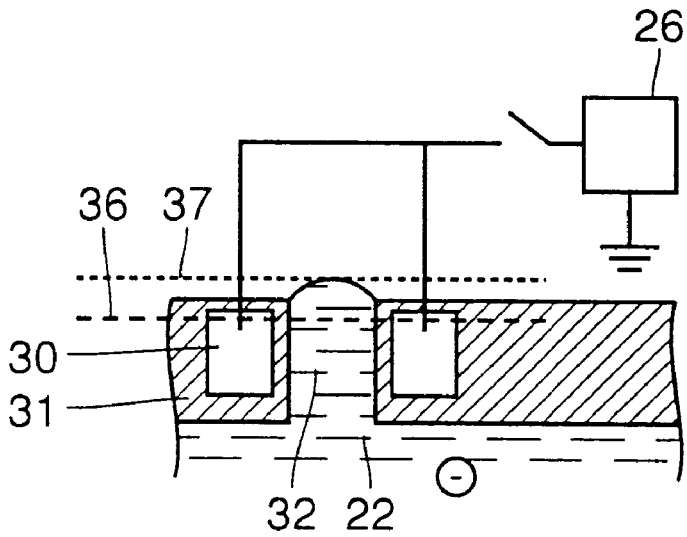
FIG. 3 shows ink surface positioned high represented by a dotted line 37, by the function of the ink control layer in the image forming apparatus in accordance with the first embodiment of the present invention.
Figure 4:
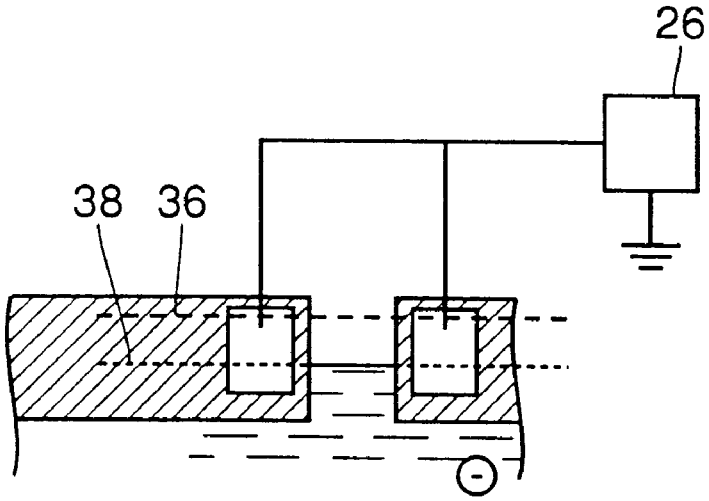
FIG. 4 shows ink surface positioned low represented by a dotted line 38, by the function of the ink control layer in the image forming apparatus in accordance with the first embodiment of the present invention.

FIGS. 3 and 4 show the principle of operation of ink control layer 23. Referring to FIG. 3, the amount of conductive ink 22 is adjusted in advance such that ink level outside the ink control layer 23 is at the position represented by the dotted line 36. When the voltage from driving power supply 26 is not applied to ink supply control electrode 30, the surface level of the ink in ink supply hole 32 is at a position represented by the dotted line 37, because of surface tension.

Referring to FIG. 4, when a predetermined negative voltage (in the present embodiment, −120 V to −200 V) is applied from driving power supply 26 to one pair of ink supply control electrodes 30, an electric field between the electrodes repulses the negative charge of the ink. The surface level of the ink moves to the position represented by the dotted line 38. The level difference of ink between the lines 37 and 38 should preferably be in the range of about 0.1 mm to about 1 mm.

Each ink supply control electrode 30 and each emission control electrode 33 are connected to driving power supplies 26 and 27, respectively. To the pair Xn of the ink supply control electrodes selected by control circuit 38, a voltage (in the present embodiment, an open voltage) which sets the ink level at a high position is applied, and to other X electrodes, a voltage (in the present embodiment, −120 V to −200 V) which sets the ink level low is applied. Thus the surface level of the ink is controlled selectively. At the same time, an emission allowing voltage is applied to a pair Ym of the emission control electrodes selected by control circuit 28, and an emission preventing voltage is applied to other electrode pairs. Consequently, whether the ink is to be emitted or not can further be selectively controlled in the region where the ink surface level is high.

The principle of ink emission when the electric field generated between the surface of conductive ink 22 and opposing electrode 6 is weaker than the strength Eth of the electric field at the start of ink emission will be described with reference to FIGS. 5 to 9.

Figures 5, 6, 7, 8, 9:
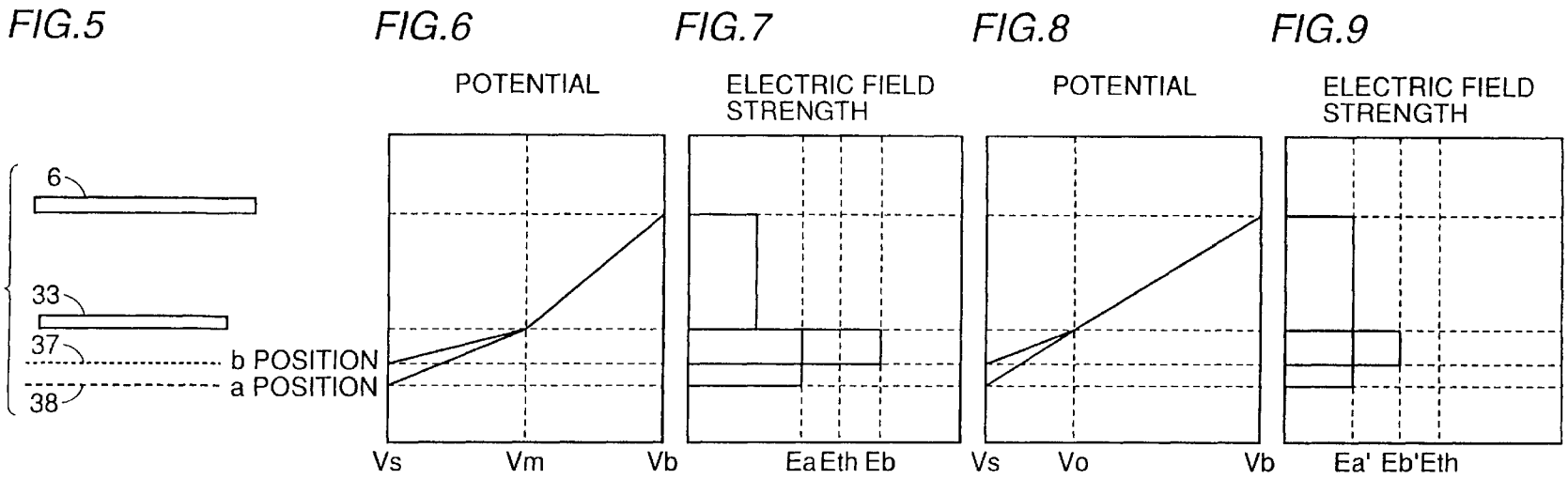
FIG. 5 schematically shows positional relation of main portions of the image forming apparatus in accordance with the first embodiment of the present invention.
FIG. 6 shows potentials of main portions of the image forming apparatus in accordance with the first embodiment of the present invention.
FIG. 7 shows strength of electric fields formed between main portions of the image forming apparatus in accordance with the first embodiment of the present invention.
FIG. 8 shows potentials of main portions of the image forming apparatus in accordance with the first embodiment of the present invention.
FIG. 9 shows strength of electric fields formed between main portions of the image forming apparatus in accordance with the first embodiment of the present invention.

FIG. 5 schematically shows positional relation between each of the ink surface level, emission control electrode 33 and opposing electrode 6. When the surface level of the ink is low, the ink surface is at the position represented by the dotted line 38, and when the level is high, the ink surface is at the position represented by the dotted line 37. Both of these positions are lower than the emission control electrode 33.

Referring to FIG. 6, when a voltage Vm (in the present embodiment, +100 V) allowing emission is applied to emission control electrode 33, then potentials at positions represented by the dotted lines 37 and 38 are both at Vs (in the present embodiment, −100 V), as compared with FIG. 5. A potential Vb (in the present embodiment, +500 V) is applied to opposing electrode 6. The strengths of electric fields at this time are as shown in FIG. 7.

Referring to FIG. 7, when the surface level of the ink is low, an electric field Ea is formed between the ink surface and emission control electrode 33. When the surface level of the ink is high, an electric field Eb is formed between the ink surface and emission control electrode 33. Strengths of Vm, Vs and Vb are selected such that the relation $Ea<Eth<Eb$ holds, where Eth represents electric field strength at the start of ink emission. More specifically, when the voltage Vm (in the present embodiment, +100 V), which is the voltage when emission is allowed, is applied to emission control electrode 33, ink is not emitted if the ink surface level is low, and ink is emitted only when the surface level of the ink is high.

The ink particles which are emitted by the electric field Eb reaches emission control electrode 33 and, by the electric field between emission control electrode 33 and opposing electrode 6, further travels toward the opposing electrode to be transferred to recording medium 7. At this time, the diameter of ink supply hole 32 is determined in advance such that the emitted ink particles each have an appropriate diameter. Accordingly, ink particles having uniform diameter and uniformly charged can readily be obtained, and ink particles are not divided in the middle of the travel.

Referring to FIG. 8, assume that a voltage Vo (in the present embodiment, 0 V), which is the potential for preventing emission, is applied to emission control electrode 33, the potential at ink surface at the positions of dotted lines 37 and 38 is at Vs (in the present embodiment, −100 V), and a potential Vb (in the present embodiment, +500 V) is applied to opposing electrode 6. FIG. 9 shows strengths of the electric fields at this time.

Referring to FIG. 9, electric field strength when the surface level of the ink is low is Ea', and the electric field strength when the surface level of the ink is high is Eb'. The strength of Vo is selected to satisfy the relation Ea'<Eb'<Eth. More specifically, when the voltage Vo (in the present embodiment, 0 V), which is the voltage for preventing emission, is applied to emission control electrode 33, ink is not emitted no matter whether the surface level of the ink is high or low. By such control of ink level, stable and reliable ink emission control is possible.

The principle of ink emission when the electric field generated between the surface of conductive ink 22 and opposing electrode 6 is stronger than the electric field Eth at the start of ink emission will be described with reference to FIGS. 10 to 14.

Figures 10, 11, 12, 13, 14:
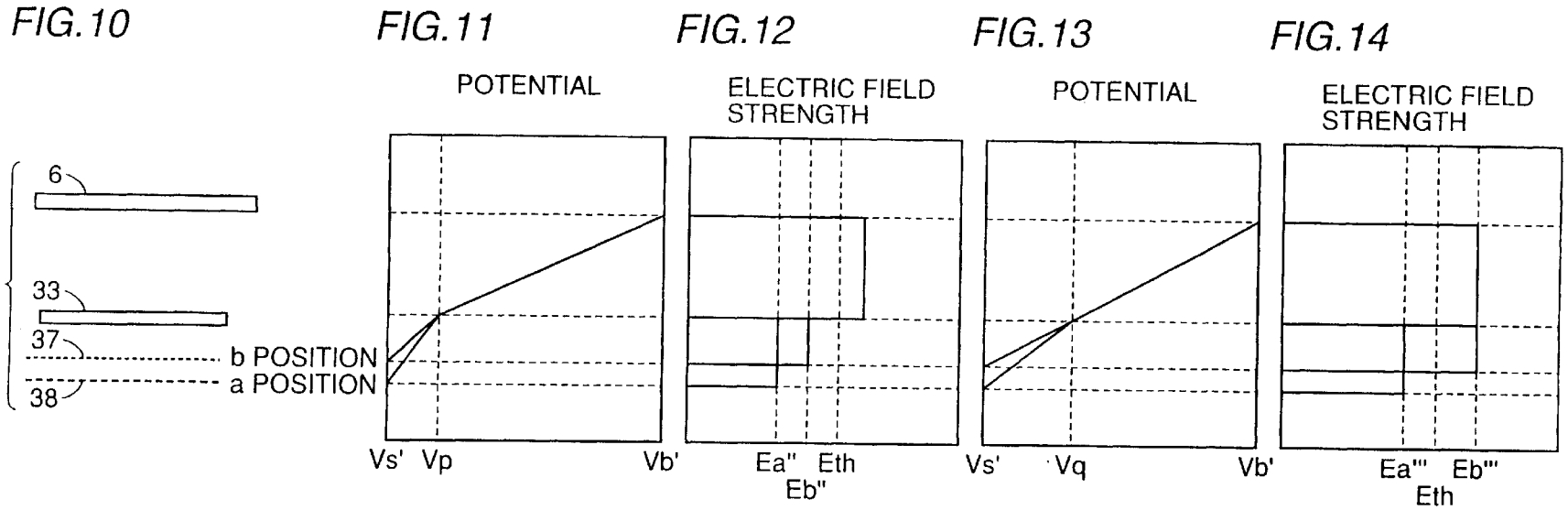
FIG. 10 schematically shows positional relation of the main portions of the image forming apparatus in accordance with the first embodiment of the present invention.
FIG. 11 shows potentials of the main portions of the image forming apparatus in accordance with the first embodiment of the present invention.
FIG. 12 shows strength of electric fields formed between main portions of the image forming apparatus in accordance with the first embodiment of the present invention.
FIG. 13 shows potentials of the main portions of the image forming apparatus in accordance with the first embodiment of the present invention.
FIG. 14 shows strength of electric fields formed between main portions of the image forming apparatus in accordance with the first embodiment of the present invention.

FIG. 10 corresponds to FIG. 5, schematically showing the positional relation between each of the ink surface level, emission control electrode 33 and opposing electrode 6.

Referring to FIG. 11, a voltage Vp (in the present embodiment, 0 V), which is the potential preventing emission, is applied to emission control electrode 33, the potential of ink surface at positions represented by dotted lines 37 and 38 is Vs' (in the present embodiment, −100 V), and a potential Vb' (in the present embodiment, +800 V) is applied to opposing electrode 6. The strengths of electric fields at this time are as shown in FIG. 12, that is, it is Ea" when the surface level of the ink is low, and it is Eb" when the surface level of the ink is high, and the relation Ea"<Eb"<Eth is satisfied. More specifically, if the voltage Vp (in the present embodiment, 0 V), which is the voltage preventing emission, is applied to emission control electrode 33, ink is not emitted no matter whether the surface level of the ink is high or low.

Referring to FIG. 13, assume that a voltage Vq (in the present embodiment, +100 V), which is the voltage allowing emission, is applied to emission control electrode 33, the potential of the ink surface at positions represented by the dotted lines 37 and 38 is Vs (in the present embodiment, −100 V), and the potential of opposing electrode 6 is Vb' (in the present embodiment, +800 V). The strengths of electric fields at this time are as shown in FIG. 14, that is, it is Ea'" when the surface level of the ink is low, and it is Eb'" when the surface level of the ink is high, and a relation Ea'"<Eth<Eb'" is satisfied. More specifically, when the voltage Vq (in the present embodiment, +100 V), which is the voltage allowing emission, is applied to emission control electrode 33, ink is not emitted if the surface level of the ink is low, and ink is emitted only when the surface level of the ink is high.

The ink particles emitted by electric field Eb'" reaches emission control electrode 33. Ink particles further travel toward the opposing electrode because of the electric field between emission control electrode 33 and opposing electrode 6, and transferred to recording medium 7. The diameter of ink supply hole 32 is determined in advance such that the emitted ink particle has an appropriate diameter. Accordingly, ink particles having uniform diameter and uniformly charged can readily be obtained, and the ink particles are not divided in the middle of the travel. Therefore, the image forming apparatus in accordance with the first embodiment enables stable and reliable ink emission control.

Further, ink supply holes 32 are arranged to form a plurality of columns of ink particle supply holes parallel in the x direction, with adjacent dots partially overlapped with each other, so as to present a line image by the continuous dots. A plurality of ink particle passage slits are formed parallel to each other in the y direction crossing the plurality of columns of the ink particle supply holes. Therefore, by controlling the timing of control of the ink particle supply holes and the ink particle passage slits by control circuit 28, it is possible to stably and reliably control ink emission dot by dot based on the above described principle, and to form an image.

Finally, the ink particles emitted in the direction to the opposing electrode 6 are adhered on moving recording medium 7, dried, and the final image is obtained.

Second Embodiment

Figure 15:
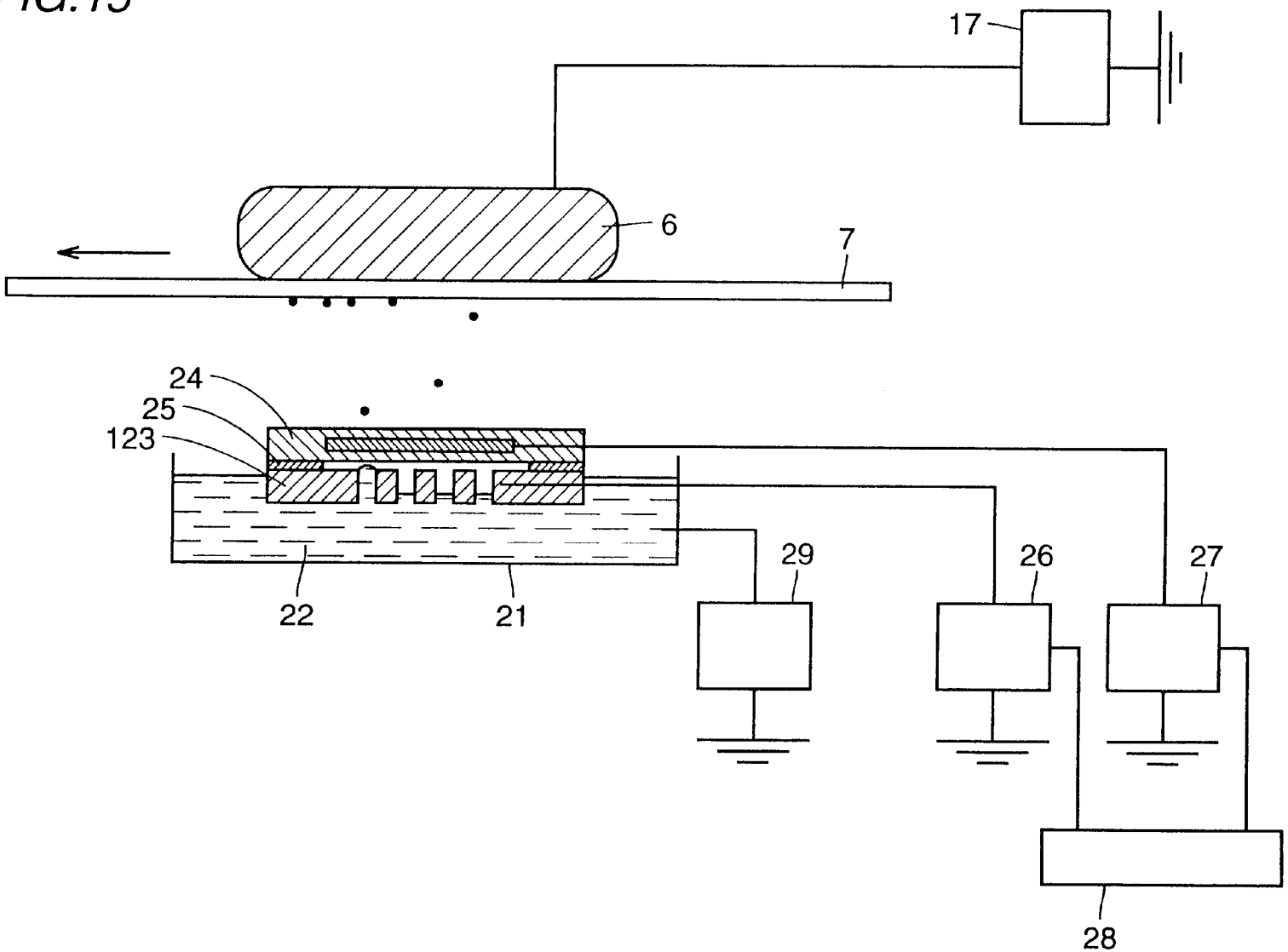
FIG. 15 schematically shows the structure of the image forming apparatus in accordance with the second embodiment of the present invention.

An image forming apparatus in accordance with a second embodiment of the present invention will be described. FIG. 15 schematically shows the structure of the apparatus. In FIG. 15, portions similar to those of the apparatus of the first embodiment are denoted by the same reference characters. Functions of these portions are also similar. Therefore, detailed description thereof is not repeated here.

The image forming apparatus shown in FIG. 15 differs from that of FIG. 1 in that an ink control layer 123 for mechanically controlling the surface level of conductive ink 22 is provided, in place of ink control layer 23 of FIG. 1.

Figure 16:
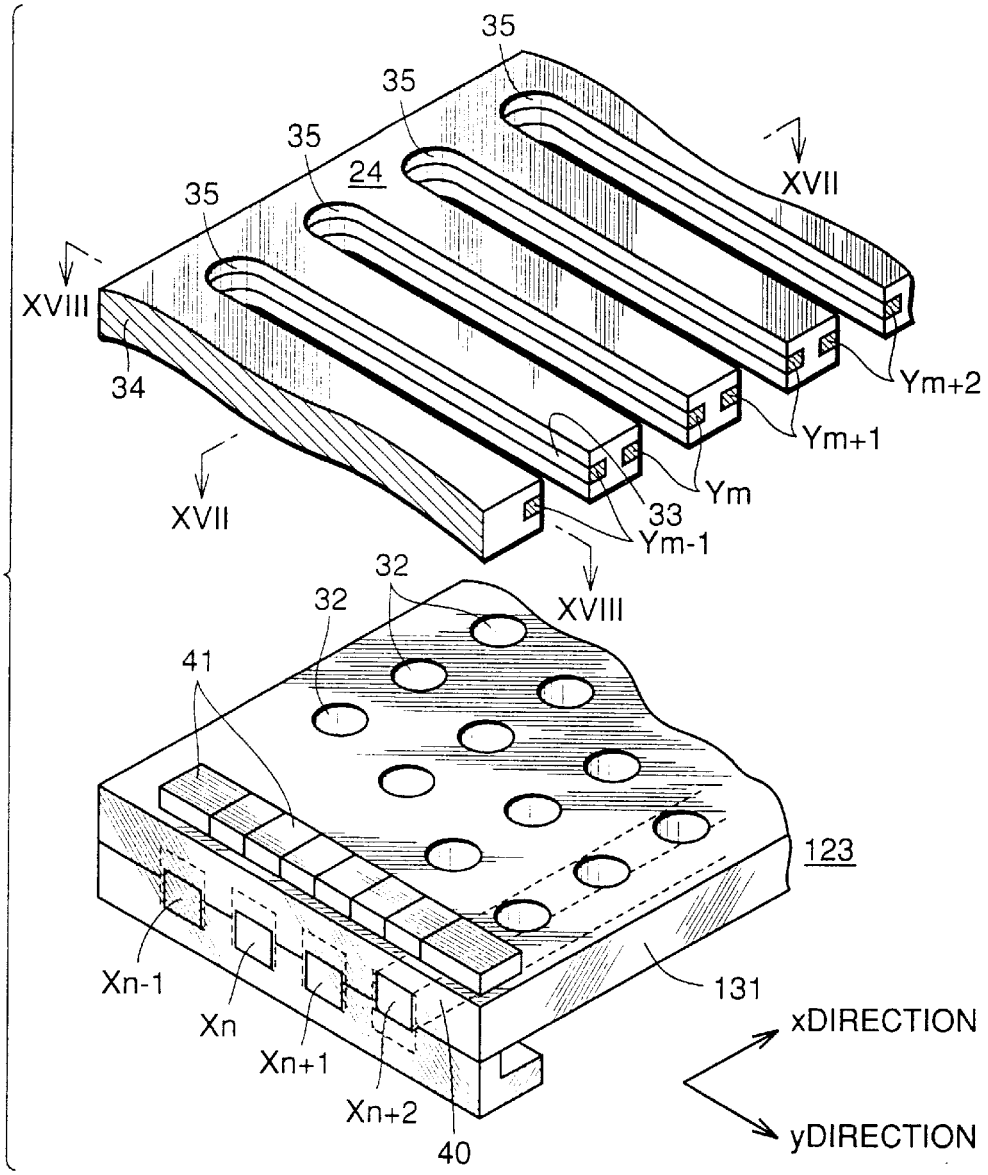
FIG. 16 is a perspective view partially in cross section showing, in enlargement, the ink control layer and the potential control layer of the image forming apparatus in accordance with the second embodiment of the present invention.

Referring to FIG. 16, ink control layer 123 includes an insulator 31 in the form of a thin plate having the thickness of several mm to about 1 cm, having ink supply holes 32 formed at a predetermined pitch along the X direction. Diameter of the ink supply hole 32 is predetermined such that the ink particle when the ink is emitted has an appropriate diameter. Ink control layer 123 further includes a plurality of plate shaped magnetic bodies 40 incorporated in a lower portion of ink supply holes 32 to be parallel to the longitudinal direction (x direction) of the ink control layer 123. On a surface of insulator 31 above opposing ends of the plurality of plate shaped magnetic bodies 40, a plurality of electromagnets 41 are provided, corresponding to the plate shaped magnetic bodies 40, respectively.

Similar to the first embodiment, emission control layer 24 is positioned at a close distance of 0.5 to 1 mm from the upper surface of ink control layer 23 by means of a spacer 25 (see FIG. 15). Electromagnet 41 may also serve as spacer 25. Emission control layer 24 includes an insulator 34 in the shape of a film or a thin plate having the thickness of 0.05 to several mm, and a plurality of emission control electrode 33 (Y direction electrodes) in the direction crossing the plate shaped magnetic bodies 40, embedded therein. Ink particle passage slits 35 are provided along the pairs Ym of the emission control electrodes.

The image forming apparatus in accordance with the second embodiment structured as described above operates in the following manner.

The voltage is applied by an external power supply 29 to conductive ink 22 in ink tank 21 so that the ink surface attains −100 V. Conductive ink 22 is uniformly charged with no variation of the amount of charges.

Figure 17:
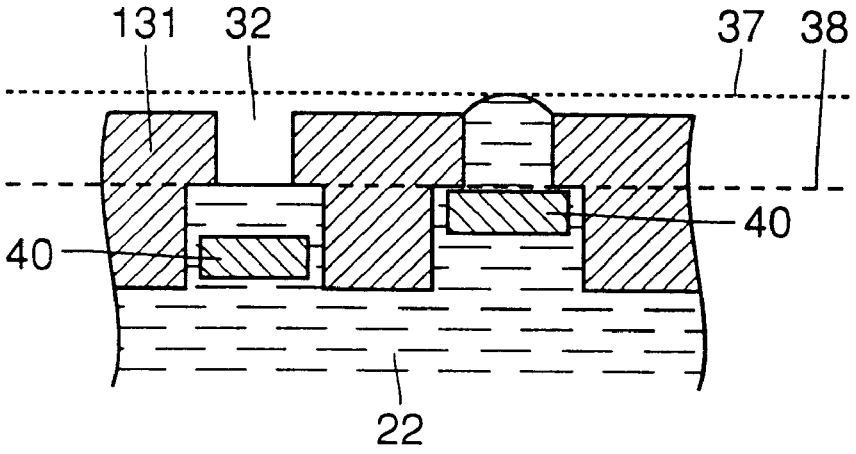
FIG. 17 is a cross section taken along the line XVII—XVII of FIG. 16.
Figure 18:
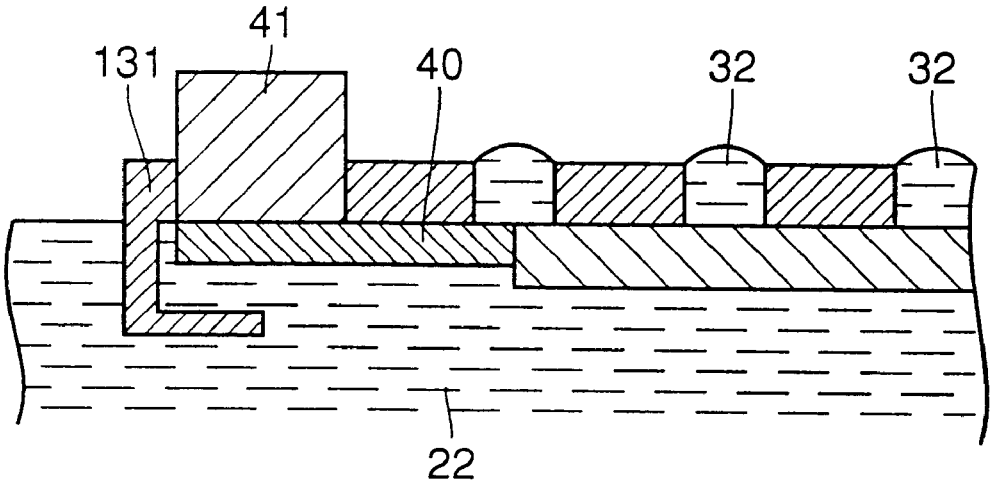
FIG. 18 is a cross section taken along the line XVIII—XVIII of FIG. 16.

The principle of operation of ink control layer 23 is shown in FIGS. 17 and 18. Referring to the left side of FIG. 17, when electromagnet 41 is not driven by the driving power supply 26, the plate shaped magnetic body 40 is at a lower position, and the surface level of the ink is at a position represented by the dotted line 38.

Referring to the right side of FIG. 17 and FIG. 18, when electromagnet 41 is driven by the driving power supply 26, plate shaped magnetic body 40 moves upward rapidly, and the surface level of the ink attains to the position represented by the dotted line 37. The level difference of ink between dotted lines 37 and 38 should preferably be in the range of about 0.1 mm to about 1 mm.

Each electromagnet 41 and each emission control electrode 33 are connected to driving power supplies 26 and 27 operating in accordance with the signal from control circuit 28 generating the signal in accordance with the image information, respectively. Electromagnet 41 corresponding to the plate shaped magnetic body Xn selected by control circuit 28 is driven to raise the ink surface to a high position, and electromagnets 41 corresponding to other plate shaped magnetic bodies X are not driven. At the same time, to the pair Ym of the emission control electrodes selected by control circuit 28, the emission allowing voltage is applied, and to other electrode pairs, the emission preventing voltage is applied.

In this manner, as the surface level of the ink surface and the voltages to be applied to the emission control electrode are controlled in combination, similar effects as provided by the first embodiment described with reference to FIGS. 5 to 14 can be obtained.

Ink supply holes 32 are formed in a plurality of columns of ink particle supply holes parallel to each other in the x direction with adjacent dots partially overlapped, so that a line image is represented by the continuous dots. Further, a plurality of ink particle passage slits are formed parallel in the y direction crossing the plurality of columns of ink particle supply holes, and therefore by changing the timing of control of the ink particle supply holes and the ink particle passage slits by control circuit 28, ink emission can be stably and reliably controlled dot by dot to form an image, based on the principle described above.

Finally, the ink particles emitted to the direction of opposing electrode 6 adheres to moving recording medium 7 are dried, and the final image is obtained.

Though the ink level in the ink supply hole is controlled utilizing a magnetic body and magnetic force in the present invention, it is only an example and other method of controlling ink level in the ink supply hole by other mechanical force is naturally encompassed by the scope of the present invention.

Third Embodiment

Figure 19:
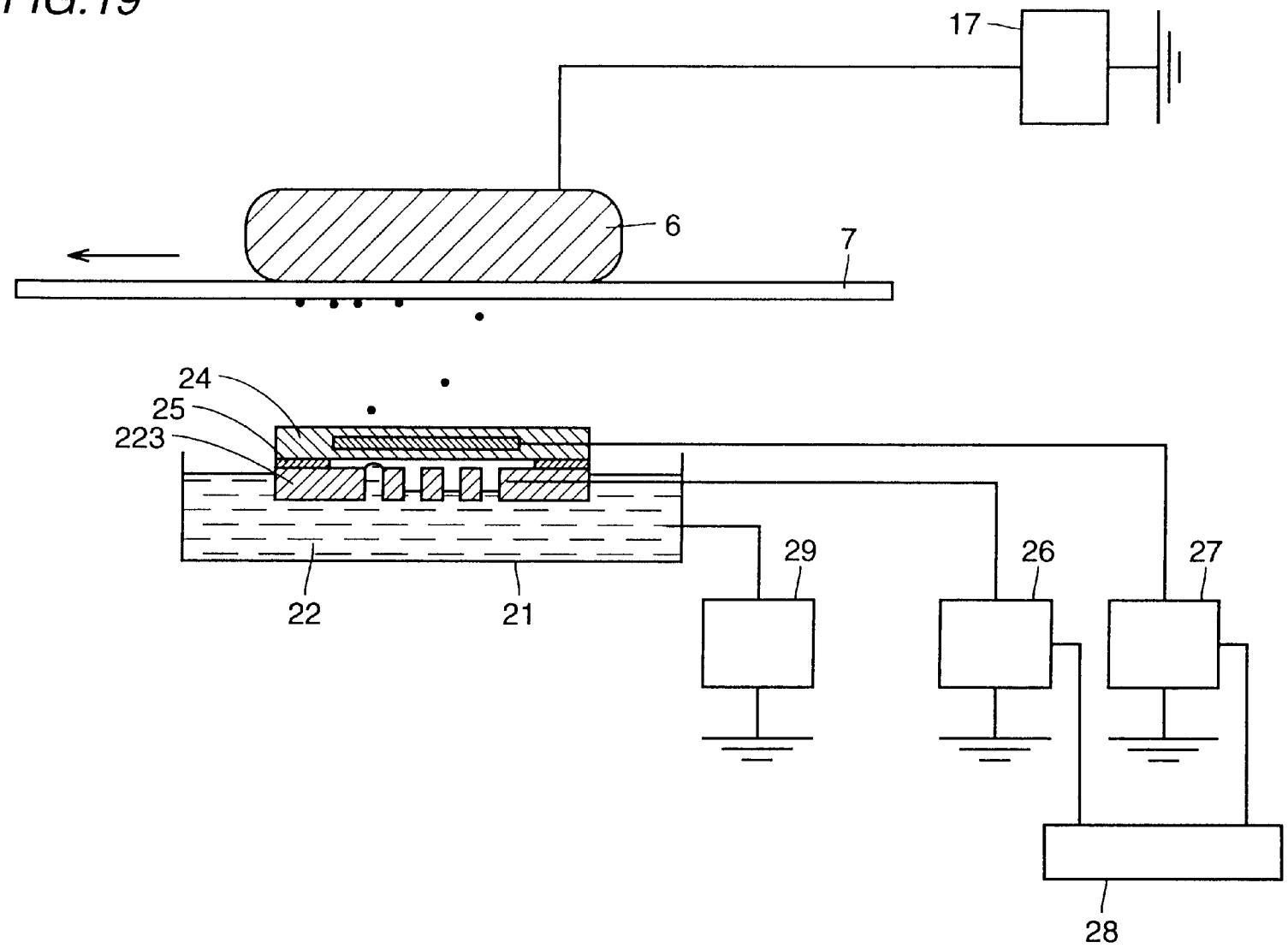
FIG. 19 schematically shows a structure of the image forming apparatus in accordance with a third embodiment of the present invention.

Third embodiment of the present invention will be described with reference to the figures. FIG. 19 shows a schematic structure of the apparatus. In FIG. 19, similar portions as those of the first embodiment shown in FIG. 1 are denoted by the same reference characters. These portions have similar functions. Therefore, detailed description thereof is not repeated here.

The image forming apparatus shown in FIG. 15 differs from that of FIG. 1 in that an ink control layer 223 for controlling surface level of conductive ink 22 utilizing thermal expansion of an object is provided in place of ink control layer 23 of FIG. 1.

Figure 20:
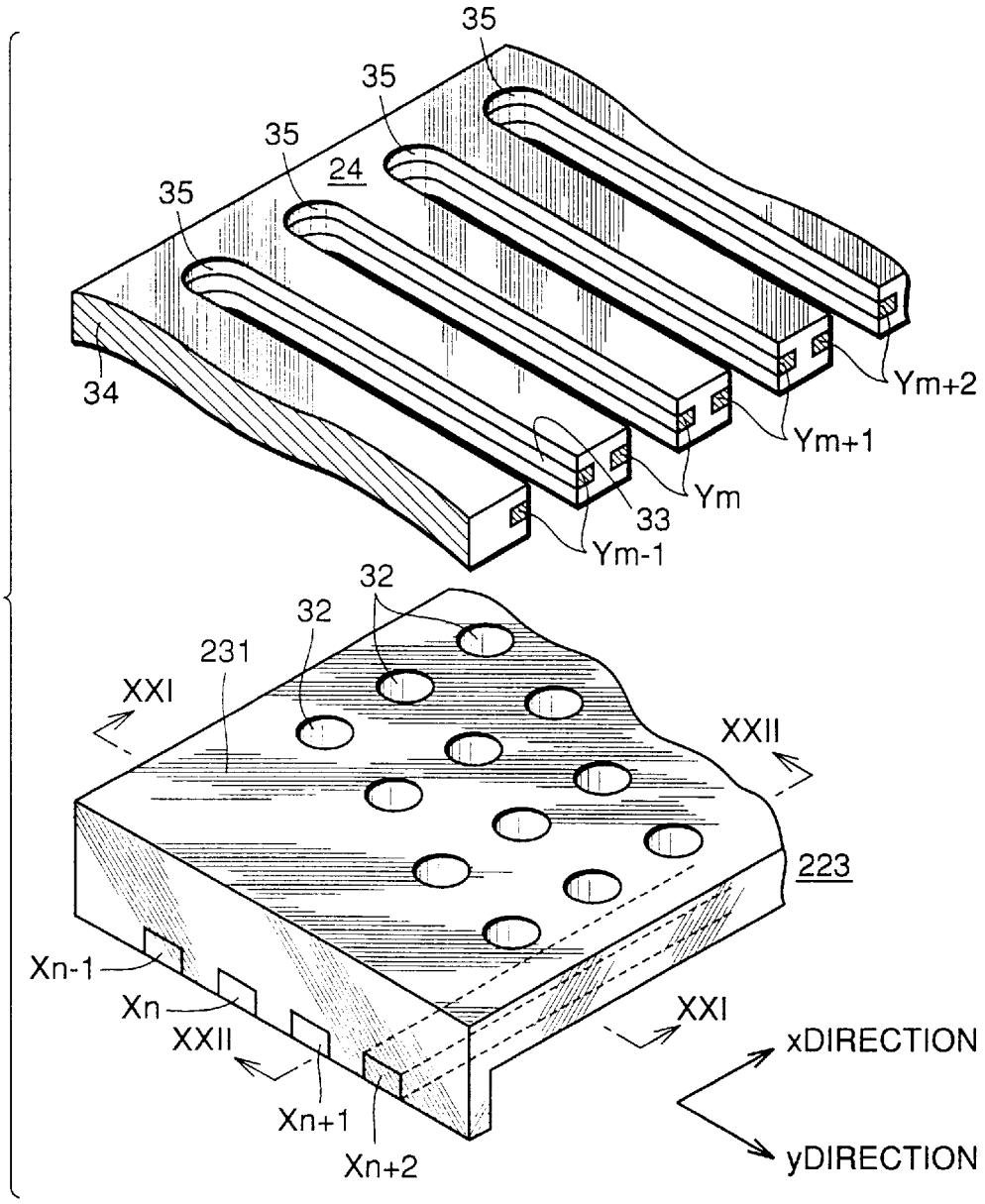
FIG. 20 is a perspective view partially in cross section showing, in enlargement, the ink control layer and the potential control layer of the image forming apparatus in accordance with the third embodiment of the present invention.
Figure 21:
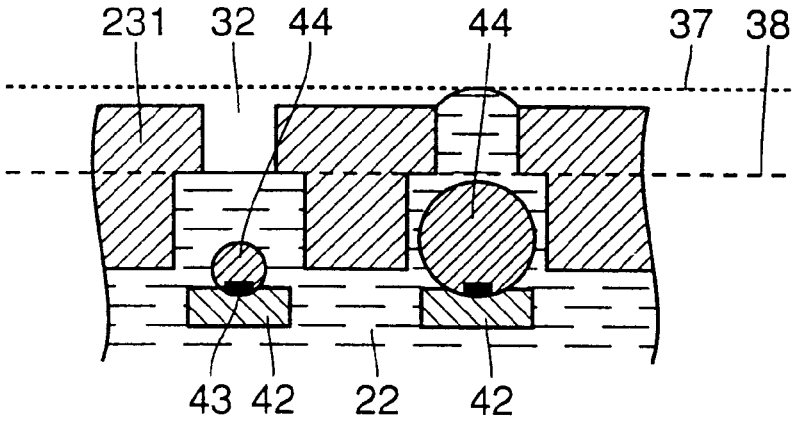
FIG. 21 is a cross section taken along the line XXI—XXI of FIG. 20.
Figure 22:
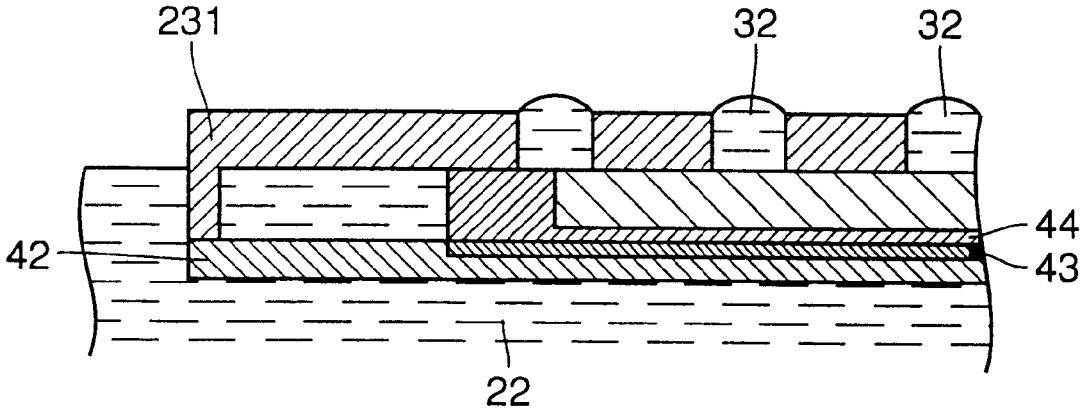
FIG. 22 is a cross section taken along the line XXII—XXII of FIG. 20.
Figure 23:
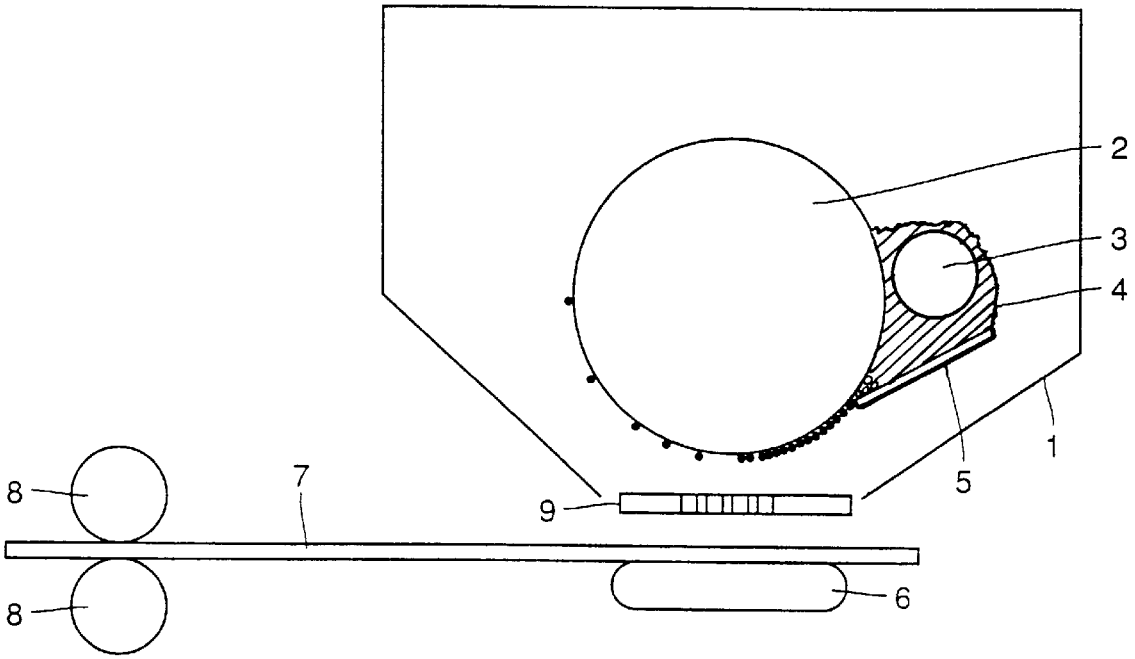
FIG.23 PRIOR ART
FIG. 23 shows a schematic structure of the conventional image forming apparatus.
Figure 24:
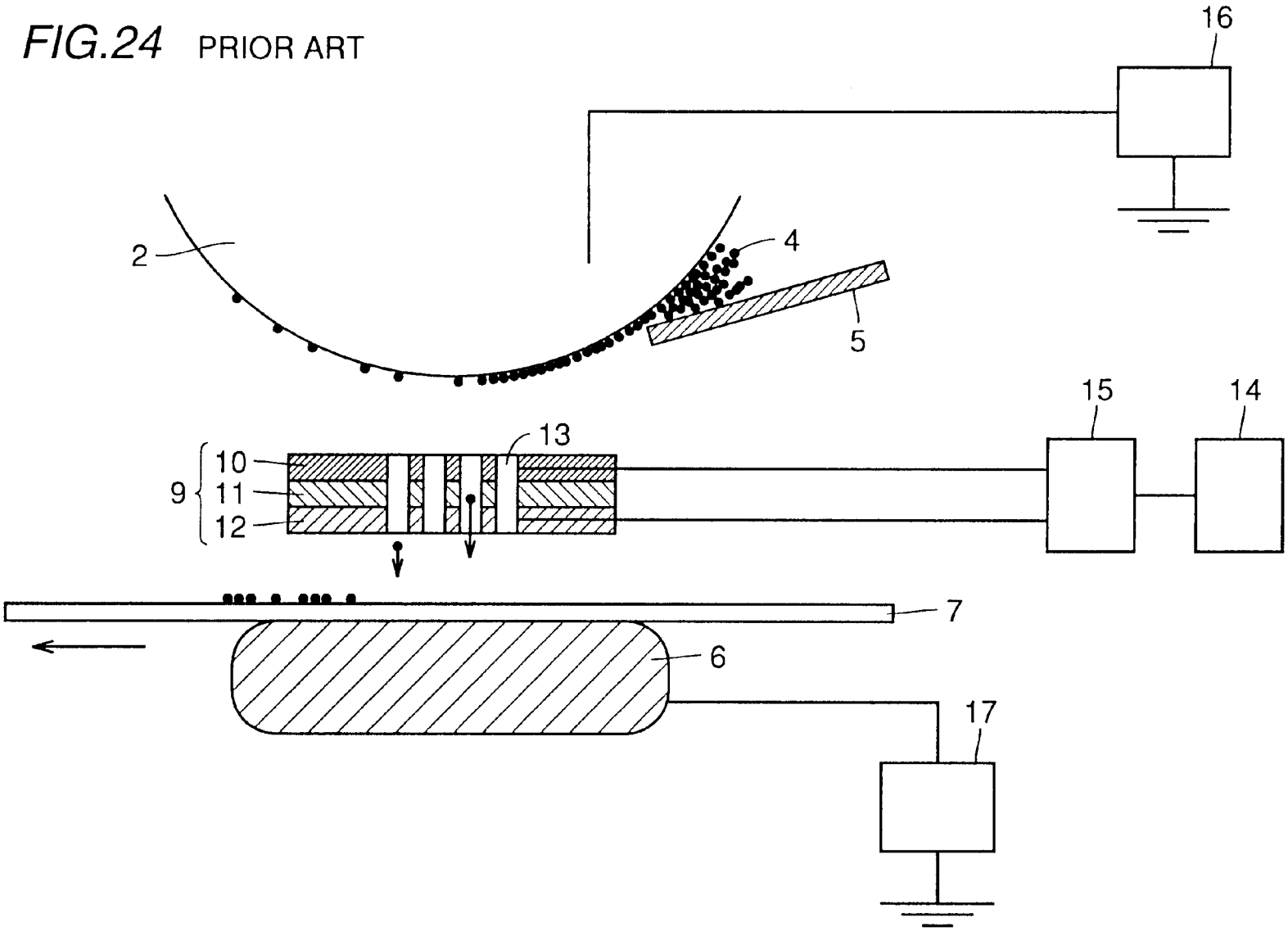
FIG.24 PRIOR ART
FIG. 24 is an enlarged view of a particle emitting portion of the prior art.
Figure 25:
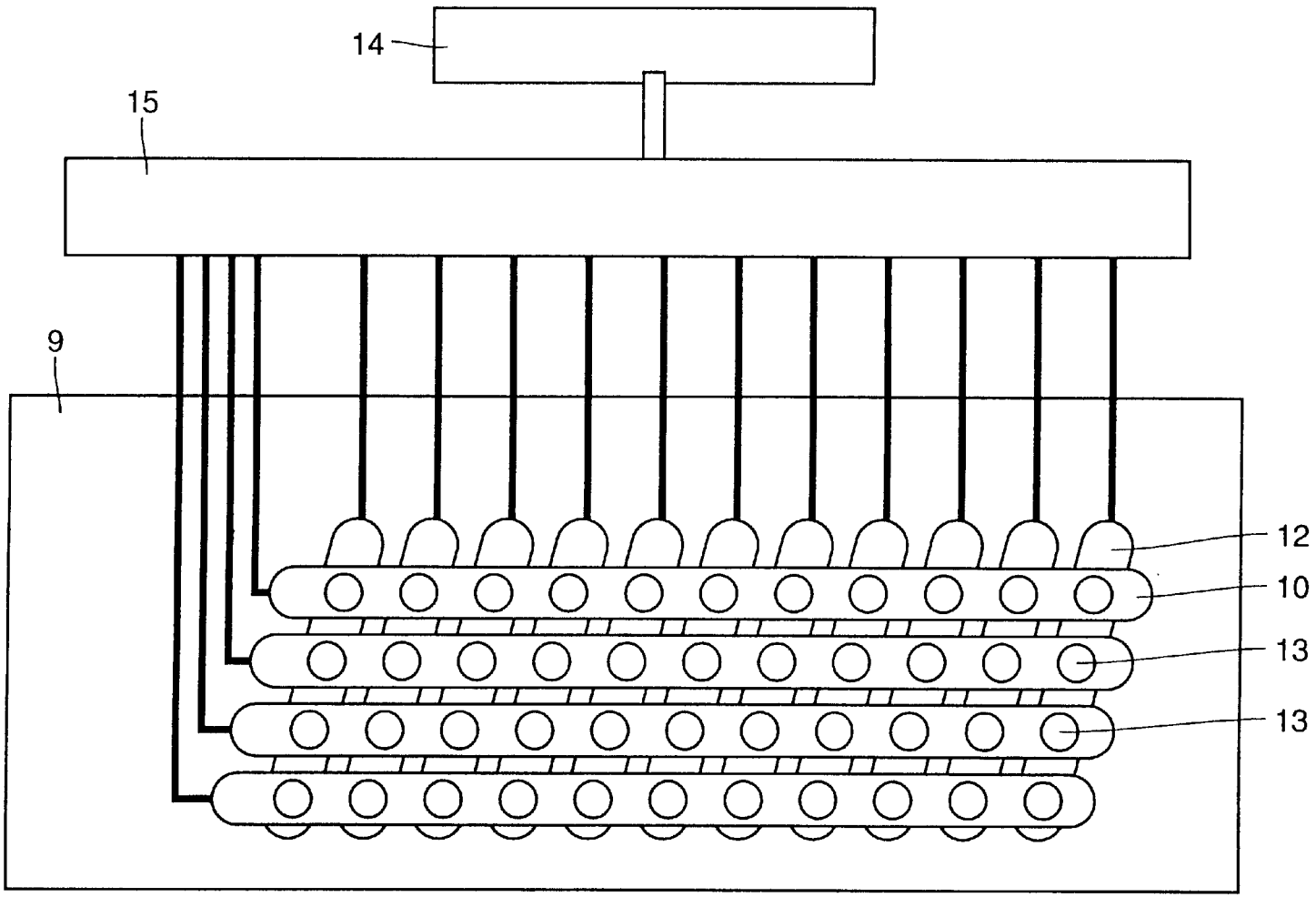
FIG.25 PRIOR ART
FIG. 25 is an enlarged view showing a structure of the control electrode portion of the prior art.

Referring to FIGS. 20 to 22, ink control layer 223 includes an insulator 231 in the shape of a thin plate having the thickness of about several mm to about 1 cm, having a plurality of ink supply holes 32 formed at a predetermined pitch along the x direction. The diameter of ink supply hole 32 is predetermined such that the ink particle has an appropriate diameter when emitted. Ink control layer 223 further includes a plurality of plate shaped holding bodies 42 incorporated at a lower portion of ink supply holes 32 to be parallel to each other in the longitudinal direction (X direction) of ink control layer 223, a heater 43 provided on an upper portion of plate shaped holding body 42, and an expandable elastic body 44 containing a gas (nitrogen, air or the like) therein, provided on and in contact with heater 43. For simplicity of drawing, heater 43 and elastic body 44 are not shown in FIG. 20.

Emission control layer 24 is the same as emission control layer 24 shown in FIG. 2. Therefore, detailed description thereof is not repeated.

The image forming apparatus structured as described above operates in the following manner. A voltage is applied to conductive ink 22 in ink tank 21 by an external power supply 29 so that the ink surface attains −100 V. conductive ink 22 is uniformly charged with no variation in the amount of charges.

Referring to the left side of FIG. 21, when heater 43 is not driven by driving power supply 26 and therefore not generating any heat, elastic body 44 is contracted, and the surface level of the ink is at the position represented by the dotted line 38.

Referring to the right side of FIG. 21 and FIG. 22, when heater 43 is driven by driving power supply 26 and radiates heat, elastic body 44 rapidly expands, so that the surface level of the ink reaches the position represented by the dotted line 37. The level difference of ink represented by the dotted lines 37 and 38 should preferably be in the range of about 0.1 mm to about 1 mm.

Heater 43 and each emission control electrode 33 are connected to driving power supplies 26 and 27 operating in accordance with a signal from control circuit 28 generating the signal in accordance with image information, respectively. Heater 43 corresponding to the plate shaped holding body Xn selected by control circuit 28 is driven to radiate heat so as to raise the ink surface to a high position, while heaters 43 corresponding to other plate shaped holding bodies Xn are not driven. At the same time, emission allowing voltage is applied to a pair Ym of the emission control electrodes selected by control circuit 28, and the emission preventing voltage is applied to other electrode pairs. In this manner, control of the surface level of the ink is combined with control of voltages to be applied to emission control electrodes, and therefore similar effect as obtained by the first embodiment described with reference to FIGS. 5 to 14 can be obtained.

The ink supply holes 32 are formed as a plurality of columns of ink particle supply holes parallel to each other in x direction with adjacent dots partially overlapped, so that a line image can be represented by continuous dots. Further, a plurality of ink particle passage slits parallel in y direction crossing the plurality of columns of ink particle supply holes are formed. Therefore, by changing the timing of control of ink particle supply holes and ink particle passage slits by control circuit 28, it is possible to stably and reliably control ink emission dot by dot to form an image, based on the principle described above. Finally, the ink particle emitted toward opposing electrode 6 are adhered on moving recording medium 7, dried, and a final image is obtained.

In the present embodiment, the ink level in the ink supply hole is controlled utilizing a heater and an elastic body containing gas, as an example. However, the present invention is not limited to the present embodiment. A method of controlling ink level in the ink supply hole by other thermal principle (for example, expansion of ink itself, expansion of heater itself, or expansion of the plate shaped holding body itself) is naturally encompassed by the scope of the present invention.

In the first to third embodiments above, one ink supply hole corresponds to one pixel. However, it is not necessary. The present invention is similarly applicable to an image forming apparatus in which a plurality of ink supply holes constitute one pixel. Though conductive ink is used in the first to third embodiments, the ink which may be used in the present invention is not limited thereto. For example, the basic principle of the present invention is applicable when an ink having charged fine particles therein may be used. Further, polarities and potentials of respective electrodes (conductive ink 12, opposing electrode 6, emission control electrodes 33) in the first to third embodiments described above are not limited to those specified above, and these may be appropriately changed dependent on the distance between electrodes, level difference of ink surface and so on.

Further, the present invention is not limited to the embodiments described above and shown in the drawings. Various modifications may be made within the scope of the present invention.

In the method and apparatus of image formation in accordance with the present invention, ink emission is controlled by the electric fields and, further, surface level of the ink is also controlled. Therefore ink emission can be controlled more accurately and stably for a long period of time, and therefore good image quality can be ensured stably for a long period of time. Further, it is not necessary to use the conventional complicated matrix electrodes for the control electrodes, and therefore cost can be reduced.

Further, as ink is used, fine particles of ink having uniform diameter and uniformly charged can readily be obtained. Developer particles are not deposited on the surface of the control electrode, and developing particles do not clog the developer particle passage holes. As a result, according to the apparatus and method of image formation of the present invention, good image quality is ensured stably for a long period of time even without maintenance of the emission control electrode, including cleaning or exchange.

In the method and apparatus of image formation in accordance with the present invention, neither special charging apparatus nor fixing apparatus is necessary. As a result, manufacturing cost can be reduced and the apparatus can be made compact. Therefore, an image forming apparatus occupying only a small space can be provided.

If the surface level of the ink is controlled by an electric field, high speed control is possible, and therefore the image forming apparatus of the present invention is suitable for a high speed printer. If the surface level of the ink is mechanically controlled, it is not necessary to switch high voltage circuits. Therefore, complicated control electrode layer need not be stacked. Therefore, the image forming apparatus can be manufactured at a low cost. If the surface level of the ink is thermally controlled, it is not necessary to switch high voltage circuits. Therefore, in this case also, the image forming apparatus can be manufactured at a low cost. Further, in this case, operating portions is small in number. Therefore, it is not prone to malfunction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

an ink tank opened upward, accommodating chargeable developer ink;

an ink control layer arranged near a surface of the developer ink accommodated in said ink tank, having a lower portion opened in said developer ink, and having a plurality of ink supply holes arranged in a matrix of a prescribed number of rows and a prescribed number of columns;

a potential control layer arranged above and adjacent to said ink control layer, and having a plurality of ink passage holes arranged in column direction of said plurality of ink supply holes, allowing passage of said developer ink therethrough;

an opposing electrode arranged above and opposing to said potential control layer;

a power supply unit for applying a potential to one of or both of said developer ink and said opposing electrode, so as to generate a prescribed potential difference between said developer ink and the opposing electrode;

a surface level controller for changing, for each of said columns of said plurality of ink supply holes, a respective surface level of said developer ink in each of said ink supply holes; and an emission controller for controlling ink emission dot by dot by controlling a respective potential row by row of said plurality of ink supply holes, in the ink passage holes of said potential control layer, after the respective surface level of said developer ink in each of said ink supply holes is controlled either at a first level or at a second level, said first level allowing the developer ink to fly toward said opposing electrode, said second level prohibiting the developer ink from flying toward said opposing electrode, wherein only the developer ink in the ink supply holes where the respective surface levels of said developer ink are at said first level is allowed to fly toward said opposing electrode.

2. The image forming apparatus according to claim 1, wherein said surface level controller includes an electric field controller for controlling surface level of said developer ink in the supply holes of said ink control layer by an electric field.

3. The image forming apparatus according to claim 2, wherein said electric field controller includes an electrode provided around an upper portion of said plurality of ink supply holes of said ink control layer, and a potential applying circuit for applying a potential of same polarity as charges of said developer ink, to said electrode of said plurality of ink supply holes separately for each of said columns.

4. The image forming apparatus according to claim 1, wherein said surface level controller includes a mechanical controller for mechanically controlling surface level of said developer ink in the supply holes of the ink control layer.

5. The image forming apparatus according to claim 4, wherein said mechanical controller includes a plurality of magnetic plates provided corresponding to respective said columns of said plurality of ink supply holes, at a lower portion of each column, to be movable upward or downward, a plurality of electromagnets allowing independent electrical coupling with respective ones of said magnetic plates, provided corresponding to said plurality of magnetic plates, and a circuit for independently and successively driving said plurality of electromagnets for independently moving said plurality of magnetic plates upward or downward.

6. The image forming apparatus according to claim 1, wherein said surface level controller includes a thermal level controller for thermally controlling surface level of said developer ink in the supply holes of said ink control layer.

7. The image forming apparatus according to claim 6, wherein said thermal level controller includes a plurality of heaters provided corresponding to said columns of said plurality of ink supply holes respectively, each at a lower portion of each column, a plurality of expanding bodies provided expandable upward and expanding in response to heat, corresponding to said plurality of heaters and provided at a lower portion of each of said columns of said plurality of ink supply holes, and a circuit for successively driving said plurality of heaters.

8. The image forming apparatus according to claim 1, wherein said developer ink includes conductive ink.

9. A method of forming an image, used in an image forming apparatus including an ink tank opened upward and accommodating chargeable developer ink, an ink control layer arranged near the surface of the developer ink accommodated in said ink tank and having a lower portion opened in said developer ink and having a plurality of ink supply holes arranged in a matrix of a prescribed number of rows and a prescribed number of columns, a potential control layer arranged above and adjacent to said ink control layer, having a plurality of ink passage holes arranged in a column direction of said plurality of ink supply holes and allowing passage of said developer ink therethrough, an opposing electrode arranged opposing to and above said potential control layer, a power supply unit for applying a potential to one of or both to said developer ink and said opposing electrode, so as to generate a prescribed potential difference between said developer ink and opposing electrode, a surface level controller for changing, for each of said columns of said plurality of ink supply holes, a respective surface level of said developer ink in each of the ink supply holes, and an emission controller for controlling a respective potential of each of said rows of said plurality of ink supply holes in said potential control layer for controlling ink emission dot by dot, after the respective surface level of said developer ink in each of said plurality of ink supply holes is controlled either at a first level or at a second level, said first level allowing the developer ink to fly toward said opposing electrode, said second level prohibiting the developer ink from flying toward said opposing electrode, wherein only the developer ink in the ink supply holes where the respective surface levels of said developer ink are at said first level is allowed to toward said opposing electrode, comprising the steps of:

changing, for each of said columns of said plurality of ink supply holes, the respective surface of said developer ink in said ink supply holes either at said first level or at said second level; and controlling ink emission dot by dot by controlling the respective potential of said potential control layer of each of said rows of said plurality of ink supply holes, in the passage holes of said potential control layer.

10. The image forming method according to claim 9, wherein said step of changing said surface level includes the steps of applying a potential of prescribed polarity to said developer ink in said ink tank, and generating an electric field of said prescribed polarity using an electric field controller included in said surface level controller for controlling, by an electric field, the surface level of said developer ink in each of said columns of the supply holes of said ink control layer, above and around each of said columns of said supply holes of said ink control layer.

11. The image forming method according to claim 10, wherein said step of generating the electric field includes the step of applying a voltage of said prescribed polarity to an electrode using potential applying means for applying the voltage of said prescribed polarity, the electrode and the potential applying means being included in said electric field controller, the electrode being provided around an upper portion of said plurality of ink supply holes of said ink control layer, the voltage of said prescribed polarity being applied to the electrode of said plurality of ink supply holes independently, column by column.

12. The image forming method according to claim 9, wherein said step of changing the surface level includes the step of changing the respective surface levels of the developer ink independently for each column by a mechanical controller included in said surface level controller, for mechanically controlling the surface level of said developer ink in each of said supply holes of the ink control layer.

13. The image forming method according to claim 12, wherein said step of changing the surface level includes the step of individually and successively driving a plurality of electromagnets included in said mechanical controller, the electromagnets being provided corresponding to a plurality of magnetic plates, respectively, included in said mechanical controller, the magnetic plates being provided corresponding to said columns of said plurality of ink supply holes respectively, at a lower portion of each column to be movable upward or downward, for individually moving upward or downward said plurality of magnetic plates, so as to change the respective surface level of the developer ink above each of said magnetic plates.

14. The image forming method according to claim 9, wherein said step of changing said surface level includes the step of individually changing the surface level of said developer ink in said ink supply holes column by column, using a thermal level controller included in said surface level controller for thermally controlling the surface level of said developer ink in the supply hol es of said ink control layer.

15. The image forming method according to claim 14, wherein said step of individually changing the surface level column by column includes the step of successively driving a plurality of heaters individually for each column, so as to expand corresponding ones of a plurality of expanding bodies, the plurality of heaters being included in said thermal level controller and provided corresponding to said columns of said plurality of ink supply holes respectively, each at a lower portion of each column, the plurality of expanding bodies being provided corresponding to said plurality of heaters respectively, at a lower portion of each of said columns of said plurality of ink supply holes, expandable upward.

16. An image forming apparatus, comprising:

an ink tank opened upward and accommodating chargeable developer ink;

surface level controller arranged near a surface of said developer ink in said ink tank, responsive to a signal designating a region for image formation on a recording medium, for selectively controlling respective surface levels of said developer ink;

an opposing electrode arranged above and opposing to said ink tank;

a power supply unit for applying a potential to one of or both of said developer ink and said opposing electrode, so as to generate a prescribed potential difference between said developer ink and the opposing electrode; and electric field controller arranged intermediate between said developer ink and the opposing electrode, responsive to a signal generated in accordance with image formation, for selectively changing an electric field between the surface of said developer ink and said opposing electrode, such that the respective surface level of said developer ink in each of said plurality of ink supply holes is controlled either at a first level or at a second level, said first level allowing the developer ink to fly toward said opposing electrode, said second level prohibiting the developer ink from flying toward said opposing electrode, so as to cause emission toward said opposing electrode of the developer ink only at that portion corresponding with the region where an image is to be formed, designated by the signal generated in accordance with said image information in that region in which the respective surface levels of said developer ink in the ink supply holes are made at said first level by said surface level controller.

17. The image forming apparatus according to claim 16, wherein said surface level controller includes an electric field controller for controlling by an electric field, the surface level of said developer ink in the supply holes of said ink control layer.

18. The image forming apparatus according to claim 16, wherein said surface level controller includes a mechanical controller for mechanically controlling the respective surface levels of said developer ink in the supply holes of the ink control layer.

19. The image forming apparatus according to claim 16, wherein said surface level controller includes a thermal level controller for thermally controlling the respective surface levels of said developer ink in the supply holes of said ink control layer.

20. The image forming apparatus according to claim 16, wherein said developer ink includes conductive ink.

* * * * *